US010388479B2

(12) United States Patent
Zhai et al.

(10) Patent No.: US 10,388,479 B2
(45) Date of Patent: Aug. 20, 2019

(54) SURGE PROTECTOR, AND RELEASE MECHANISM AND BASE THEREOF

(71) Applicants: SHANGHAI CHENZHU INSTRUMENT CO., LTD., Shanghai (CN); DINKLE ENTERPRISE CO., LTD., New Taipei (TW); DINKLE ELECTRIC MACHINERY (CHINA) CO., LTD., Kushan, Jiangsu (CN)

(72) Inventors: Chunpo Zhai, Shanghai (CN); Keqi Chen, Shanghai (CN); Shang-Tsai Wu, New Taipei (TW)

(73) Assignees: SHANGHAI CHENZHU INSTRUMENT CO., LTD., Shanghai (CN); DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 102 days.

(21) Appl. No.: 15/634,420

(22) Filed: Jun. 27, 2017

(65) Prior Publication Data

US 2018/0374666 A1 Dec. 27, 2018

(51) Int. Cl.
*H01H 71/14* (2006.01)
*H01H 71/02* (2006.01)
(Continued)

(52) U.S. Cl.
CPC ..... *H01H 71/14* (2013.01); *H01C 7/12* (2013.01); *H01H 15/02* (2013.01); *H01H 37/08* (2013.01);
(Continued)

(58) Field of Classification Search
CPC .... H01H 71/14; H01H 71/0207; H01H 71/04; H01H 71/025; H01H 15/02; H01H 71/1009; H01H 2207/036; H01H 2235/01; H01H 2071/008; H01H 2207/02
USPC ..... 337/142
See application file for complete search history.

(56) References Cited

U.S. PATENT DOCUMENTS 6,430,019 B1 * 8/2002 Martenson ..... H01C 7/126 361/103
7,483,252 B2 * 1/2009 de Palma ..... H01C 7/112 361/127
(Continued)

FOREIGN PATENT DOCUMENTS

CN 203933002 U 11/2014
EP 1077452 A2 2/2001
(Continued)

OTHER PUBLICATIONS

Search Report dated Jan. 29, 2018 of the corresponding European patent application No. 17177926.7.

*Primary Examiner* — Anatoly Vortman
(74) *Attorney, Agent, or Firm* — Chun-Ming Shih; HDLS IPR Services

(57) ABSTRACT

A release mechanism for surge protectors includes a first electrical connection pin soldered with a varistor's second electrode, a function rotating member sheathed on a fixed column and installed between a varistor and a bridge bracket, an elastic driving device fixed into an internal box body, and a bridge bracket fixed to a second electrical connection pin in the internal box body (2). If the varistor is not released, then the bridge bracket will be passed through a soldering window and soldered with a varistor's first electrode, or else the elastic driving device will drive the function rotating member to rotate around the fixed column. An arc shield plate shields between the bridge bracket and electrode. A failure status indicating area is exposed and a remote linkage rod is triggered.

12 Claims, 14 Drawing Sheets

(51) Int. Cl.

| | |
|---|---|
| ***H01H 71/04*** | (2006.01) |
| ***H01H 71/10*** | (2006.01) |
| ***H01H 15/02*** | (2006.01) |
| ***H01C 7/12*** | (2006.01) |
| ***H01H 37/08*** | (2006.01) |
| ***H01H 37/76*** | (2006.01) |
| *H01H 71/00* | (2006.01) |

(52) U.S. Cl.
CPC ..... *H01H 37/76* (2013.01); *H01H 71/025* (2013.01); *H01H 71/0207* (2013.01); *H01H 71/04* (2013.01); *H01H 71/1009* (2013.01); *H01H 2037/762* (2013.01); *H01H 2071/008* (2013.01); *H01H 2207/02* (2013.01); *H01H 2207/036* (2013.01); *H01H 2235/01* (2013.01)

(56) References Cited

U.S. PATENT DOCUMENTS 7,684,166 B2 * 3/2010 Donati ..... H01C 7/126 361/103
7,839,257 B2 * 11/2010 Cernicka ..... H01C 7/126 337/142
8,031,456 B2 * 10/2011 Wang ..... H01T 1/14 361/117
8,378,778 B2 * 2/2013 Duval ..... H01C 7/126 338/13
8,526,159 B2 * 9/2013 Ludewig ..... H01C 7/126 361/111
8,836,464 B2 * 9/2014 Wang ..... H01C 7/126 337/401
9,007,163 B2 * 4/2015 Duval ..... H01C 7/126 337/1
9,165,702 B2 * 10/2015 Hagerty ..... H01C 7/126
9,640,352 B2 * 5/2017 Daum ..... H01C 7/126
2009/0161280 A1 * 6/2009 Tseng ..... H01C 7/10 361/103

FOREIGN PATENT DOCUMENTS

WO 2011102811 A2 8/2011
WO 2014027969 A2 2/2014

* cited by examiner

SURGE PROTECTOR, AND RELEASE MECHANISM AND BASE THEREOF

FIELD OF THE INVENTION

This disclosure relates to a surge protector, and more particularly to a release mechanism and a base of the surge protector.

BACKGROUND OF THE INVENTION

A surge protector is generally applied in an electric circuit and used at home, office, or factory to prevent electric equipment's from being damaged by transient overvoltage. When the electric circuit or a communication circuit produces a peak current or voltage by external interference, the surge protector is capable of conducting shunt current in a very short time to avoid electric surge from damaging other equipments in the circuit.

In general, a surge protector includes a metal oxide varistor (which is one kind of the varistors), and the varistor may be aged after a long time of use and generate heat easily. To prevent accidents such as a fire caused by the rise of temperature, the surge protector usually comes with a release mechanism connected in series with the varistor, so that when the temperature rises, the varistor is released and disconnected from the circuit. As disclosed in P.R.C. Pat. Application No. 201420368586.2, a conventional release mechanism comprises a box body, a semiconductor ceramic chip, a ceramic shielding body, and a release electrode plate. A plane of the release electrode plate is attached to one side of the semiconductor ceramic chip, and the other side of the semiconductor ceramic chip is attached to the left electrode pin. A convex side of the release electrode plate is installed into a positioning hole of the box body. The rotating hole of the ceramic shielding body is sheathed on a shaft of the box body. An edge of a soldering hole of the ceramic shielding body and the periphery of the soldering hole are covered by a solderable metal layer. The solderable metal layer is soldered with a convex side of the release electrode plate. The right electrode pin of the box body passes through the conductive wire and is soldered with the solderable metal layer. A pushrod of the spring device is installed into a slide slot. The ceramic shielding body is pushed or pulled under the effect of the elasticity of the spring. The ceramic shielding body is rotated to drive the conductive wire of the release electrode plate and the right electrode pin to move, so as to shield the electric arc. A turning block on the pushrod is used to trigger a warning switch.

However, the conventional release mechanism has the following problems: (1) The convex side of the release electrode plate is installed into the positioning hole of the box body, so that after the soldering point is disconnected, the ceramic shielding body and the release electrode plate are moved together. If the moving distance is too short, the wiring cannot be cut off completely. (2) The right electrode pin and the release electrode plate are coupled with each other by the conductive wire and the solderable metal layer, so that the connecting structure is very complicated, and occupies a large space, thus the failure rate increases.

In view of the aforementioned drawbacks of the prior art, the disclosure of this disclosure conducted extensive research and provided a feasible design to overcome the drawbacks of the prior art.

SUMMARY OF THE INVENTION

Therefore, it is a primary objective of the present invention overcome the aforementioned problems of the prior art by providing a release mechanism and a base used for a surge protector. The bridge bracket of the release mechanism remains unmoved with respect to the internal box body and will not be rotated or moved together with the function rotating member. After the varistor is released, the function rotating member is rotated between the pin of the varistor and the bridge bracket so as to cut off the electric arc and the soldering wiring between the pin of the varistor pin and the bridge bracket and achieve a complete quick release, while providing a status indication and a remote function.

To achieve the aforementioned and other objectives, this disclosure provides a base applicable for a single-stage surge protector and a multi-stage surge protector, and the base adopts a mechanical connecting structure with different independent linkages, and just one micro switch and one slider are used, and each level has the linkage of the remote linkage rod and the slider. After the release mechanism of a surge protector of any level is released, the remote device will issue a signal to assure an effective feedback to a control system for each time of release, so as to achieve the effects of improving the safety and reliability of the surge protector, providing a simple mechanism with a small quantity of components, a stable connection, a convenient production, and lowering the cost.

This disclosure further provides a release mechanism of a surge protector, and the release mechanism comprises an internal box body, a function rotating member, an elastic driving device, a first electrical connection pin, a second electrical connection pin and a bridge bracket accommodated in the a varistor, and the first electrical connection pin and the second electrical connection pin being plugged into the internal box body, and the varistor's second electrode and the first electrical connection pin being soldered, and the internal box body having a fixed column, and the function rotating member having an arc shield plate and a soldering window, and the function rotating member being sheathed on the fixed column and disposed between the varistor and the bridge bracket, and the elastic driving device having an end coupled to the function rotating member and the other end fixed to the internal box body, wherein an end of the bridge bracket directly fixed and coupled to the second electrical connection pin, such that when the varistor is situated at a normal status, the function rotating member is situated at a first position, and the other end of the bridge bracket is passed through the soldering window and soldered with a varistor's first electrode at low temperature, and when the varistor is situated at a release status, the elastic driving device drives the function rotating member to rotate around the fixed column, so that when the function rotating member is rotated to a second position, the arc shield plate provides a shielding effect between the bridge bracket and the varistor's first electrode.

In the release mechanism of this disclosure, an end of the bridge bracket is fixed and coupled to the second electrical connection pin directly, and when the varistor is situated at a normal status, the function rotating member is situated at the first position, and the other end of the bridge bracket is passed through the soldering window and soldered with the varistor's first electrode at low temperature, and when the varistor is situated at a release status, the elastic driving device drives the function rotating member to rotate around the fixed column, so that when the function rotating member is rotated to the second position, the arc shield plate provides a shielding effect between the bridge bracket and the varistor's first electrode to break open the wiring and the electric arc. Since the bridge bracket is fixed and coupled to the second electrical connection pin directly, the bridge bracket is fixed with the internal box body to skip the conductive wire coupled between the bridge bracket and the electrical connection pin. When the function rotating member is rotated, the bridge bracket will not be rotated with the function rotating member, so that the wiring is cut off completely to prevent the ceramic shielding body and the release electrode plate of the conventional surge protector from moving together. If the distance between them is too short, the wiring cannot be cut off completely.

Preferably, the soldering window has a shear slope disposed on a side of the soldering window, and the internal box body has a panel, and the panel has a varistor's first electrode passing hole (2K) aligned precisely with the soldering window, and the varistor's first electrode passing hole has a shear plane, so that when the function rotating member is rotated, the shear slope and the shear plane of the soldering window are moved with respect to each other, so as to cut off the wiring more quickly and completely.

Preferably, when the function rotating member is moved to a second position, an inner wall and the shear plane of the varistor's first electrode passing hole, the arc shield plate of the function rotating member, and a surface of the varistor's first electrode form a closed area which eliminates the electric arc more completely.

Preferably, the release mechanism has an external box body, and the external box body has a monitoring hole, and the internal box body has a failure status indicating area, and the function rotating member has a normal status indicating area, and the color of the normal status indicating area and the color of the failure status indicating area are different, and the function rotating member is situated at a first position, and the normal status indicating area is exposed from the monitoring hole, and the function rotating member is rotated to a second position, so that the failure status indicating area is disposed at and exposed from the monitoring hole, so as to achieve the release indicating function.

Preferably, the elastic driving device is a spring, and when the varistor is situated at a normal status, the function rotating member is situated at a first position, and the spring is situated at an stretched status, and when the varistor is situated at a release status, the spring is contracted, and the function rotating member is rotated from the first position to the second position around the fixed column under the effect of the spring. By using the spring to drive the function rotating member to rotate, a simple structure and an easy implementation can be achieved.

Preferably, both of the function rotating member and the internal box body are made of a temperature resisting, insulating, and flame retardant material, so that the surge protector has the temperature resisting, insulating, and flame retardant properties.

This disclosure further provides a surge protector comprising at least one varistor, a base, and at least one release mechanism.

Preferably, the base comprises a remote device, and the remote device has at least one remote linkage rod, and the function rotating member has a remote linkage rod contact wall and a remote linkage notching, and when the function rotating member is situated at a first position, the remote linkage rod is pressed down by the remote linkage rod contact wall, and when the function rotating member is rotated from the first position to a second position, the function rotating member is rotated from the remote linkage rod contact wall to the remote linkage notching with respect to the point of action of the remote linkage rod to release the remote linkage rod, so as to achieve the remote function.

Preferably, the remote device has a seat, at least one remote linkage rod spring and a micro switch, and the seat has a slide slot, a slider, at least one slider spring, and at least one spring placement hole, and the micro switch is installed in the seat and disposed under the slider, and the remote linkage rod spring is sheathed on the remote linkage rod and installed together with the remote linkage rod into the spring placement hole, and the slider is installed onto the slide slot, and at least one slider spring has an end coupled to the slider and the other end abutting against the seat sidewall; and when the function rotating member is situated at the first position, the remote linkage rod spring is situated at a maximum compression status, and the slider is stopped at an end of the slide slot by the remote linkage rod, and the slider has no action to the micro switch; and when the function rotating member is situated at a second position, at least one of the remote linkage rods pushes the slider to move along the slide slot under the pushing effect of the remote linkage rod spring, so that the slider presses the micro switch to indicate the status of the surge protector.

Preferably, the remote linkage rod has a driving slope, and the slider has a driven slope, and when the function rotating member is situated at the first position, the driven slope of the slider is stopped by the driving slope of the remote linkage rod, and when the function rotating member is rotated to the second position, the driving slope pushes the driven slope, and the slider moves along the slide slot to press down the micro switch, wherein the driven slope and the driving slope are provided for the remote linkage rod to drive the slider to slide more stably.

Preferably, the resultant force of all slider springs is smaller than the elasticity of the single remote linkage rod spring to guarantee that after a surge protector of any level is released, the remote device issues a signal to achieve the effects of providing a feedback to a control end effectively for each time of release, improving the safety and reliability of the surge protector, and reducing the quantity of components.

Preferably, the base is a pluggable base, and the base has a cover, and the cover has an U-shaped plug slot, and an inner sidewall of the U-shaped plug slot has a latch slot, and the external box body of the release mechanism has a lock, and when the release mechanism is plugged into the base, the lock is latched to the latch slot formed on an inner sidewall of the U-shaped plug slot, so that the base can be connected to the release mechanism more conveniently and quickly to prevent the release mechanism from being loosened or falling off and improve the product safety.

Preferably, the base has an electrical connection member, and the electrical connection member has a metal claw and a conductive strip, and the metal claw and the conductive strip are soldered and coupled to each other, and the metal claw and the first electrical connection pin and the second electrical connection pin of the release mechanism are clamped and coupled to form a conducting channel.

Preferably, the seat has a limit point, and the remote linkage rod has a bump, such that when the remote linkage rod is set into the seat, the bump and the limit point are latched with each other, so as to assure that the remote linkage rod will not be popped out by the spring after installation.

This disclosure further provides a base.

DESCRIPTION OF THE PREFERRED EMBODIMENTS

Figure 1:
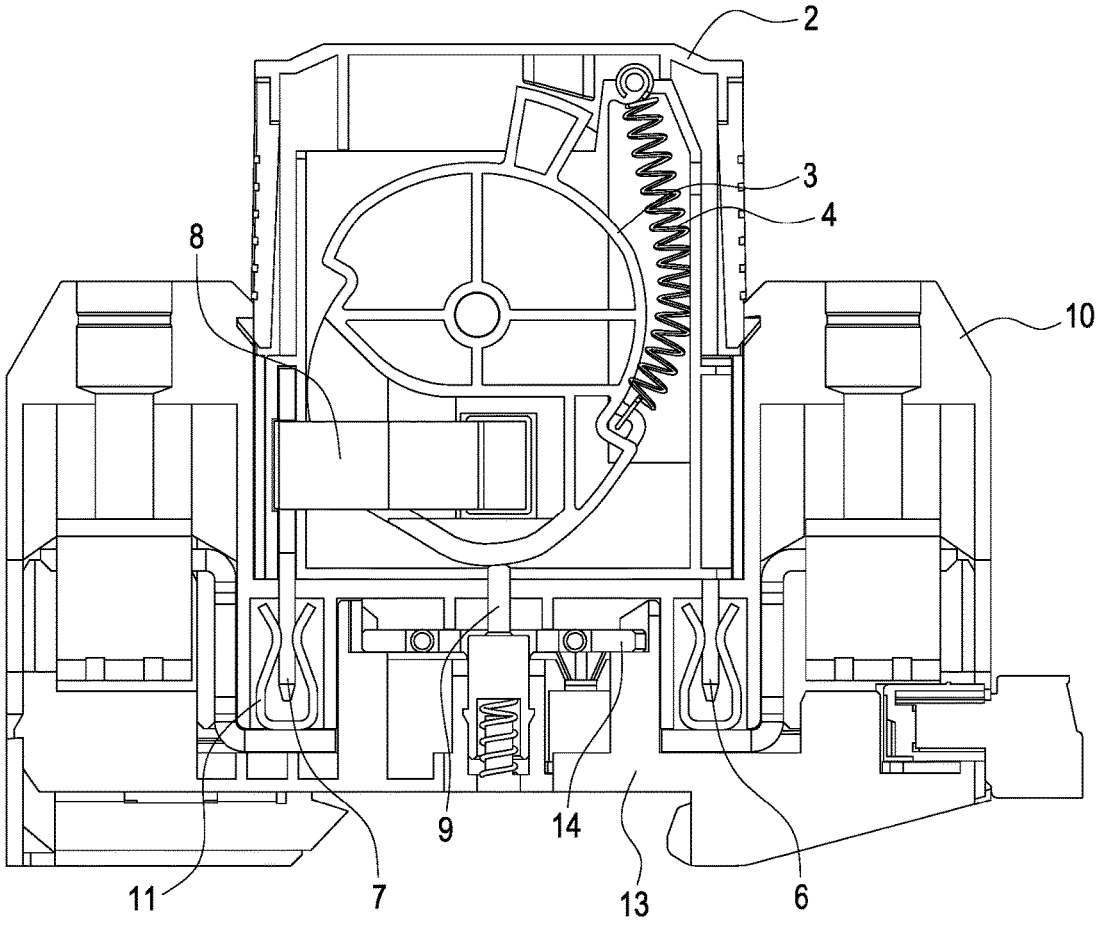
FIG. 1 is a schematic view of the overall structure of a surge protector of this disclosure.
Figure 2A:
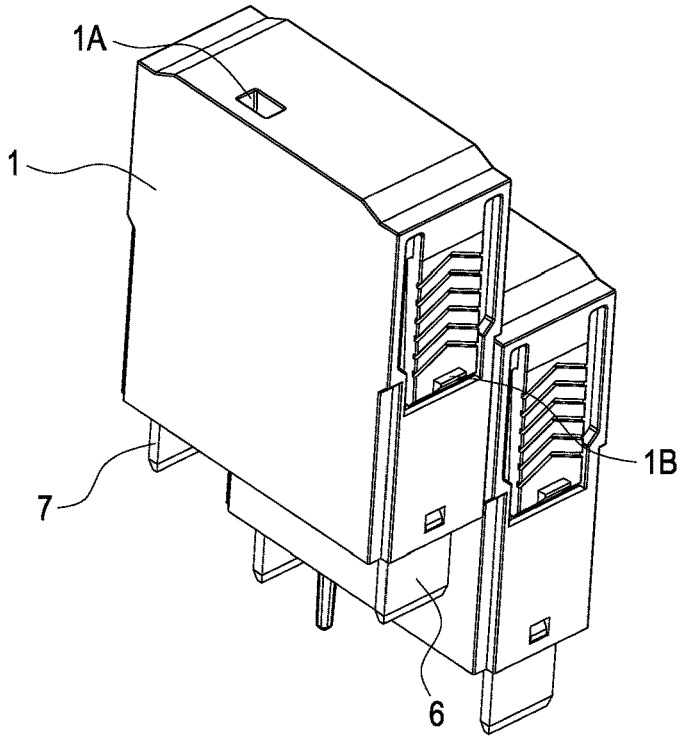
FIG. 2*a* is a schematic view of the structure of several release mechanisms of a surge protector of this disclosure.
Figure 2B:
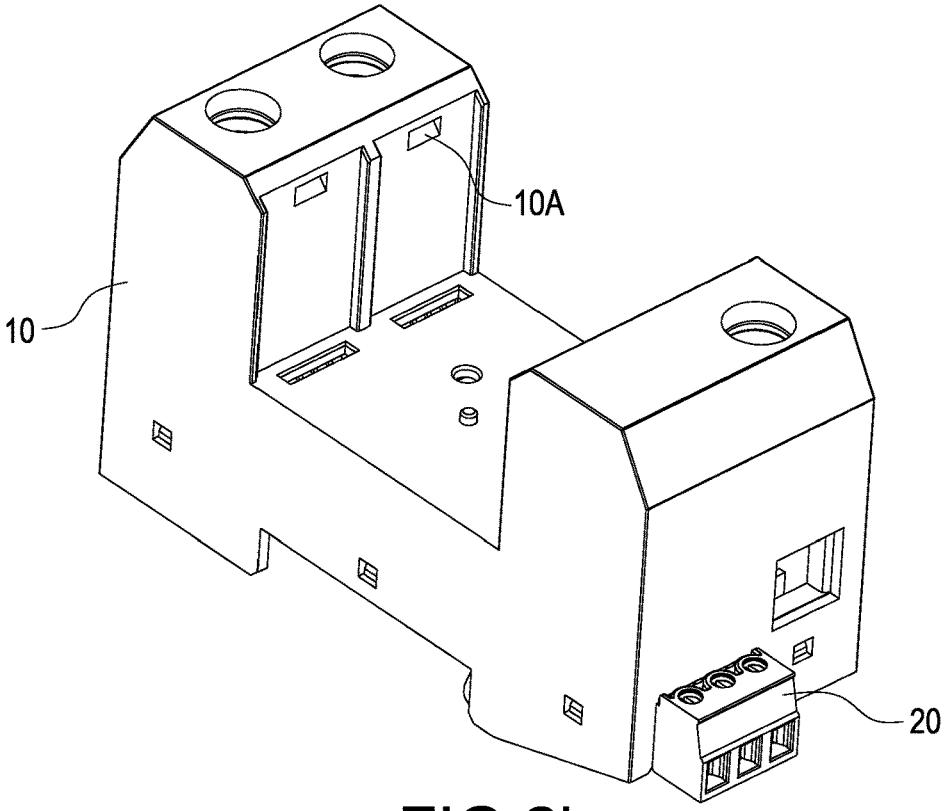
FIG. 2*b* is a schematic view of the structure of a base of a surge protector of this disclosure.

The technical contents of the present invention will become apparent with the detailed description of preferred embodiments accompanied with the illustration of related drawings as follows. It is noteworthy that the preferred embodiments are provided for illustrating this disclosure rather than restricting the scope of the disclosure.

Preferred embodiments of the release mechanism, the base and the surge protector of this disclosure will be described and illustrated according to the accompanied drawings as follows.

With reference to FIGS. 1-7 for a release mechanism of a surge protector, the release mechanism comprises an external box body 1, an internal box body 2, a function rotating member 3, an elastic driving device 4, a first electrical connection pin 6, a second electrical connection pin 7, and a bridge bracket 8.

Figure 4A:
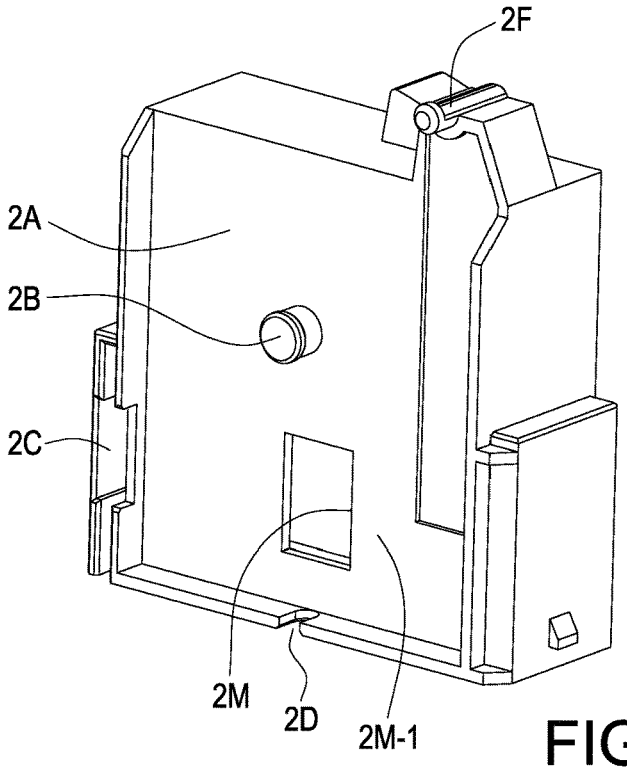
FIG. 4*a* is a front view of the structure of an internal box body a release mechanism of this disclosure.
Figure 4B:
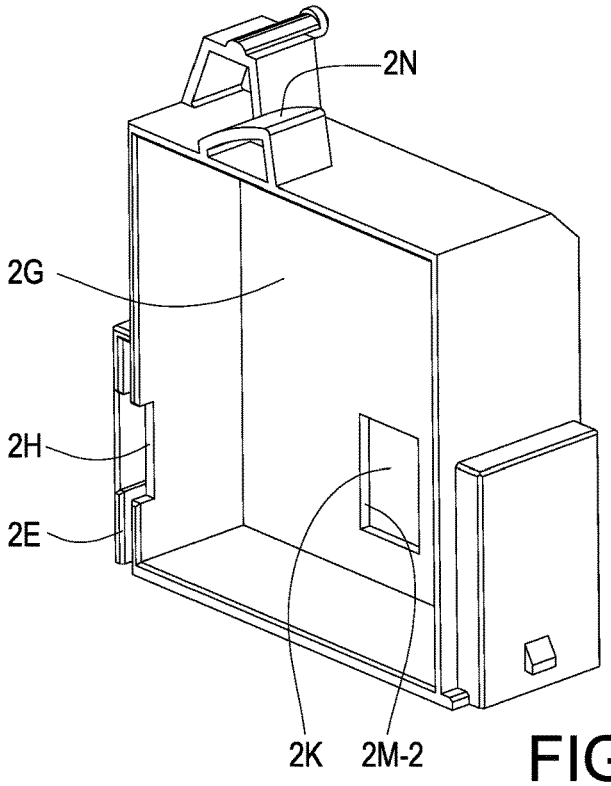
FIG. 4*b* is a back view of the structure of an internal box body a release mechanism of this disclosure.
Figure 5A:
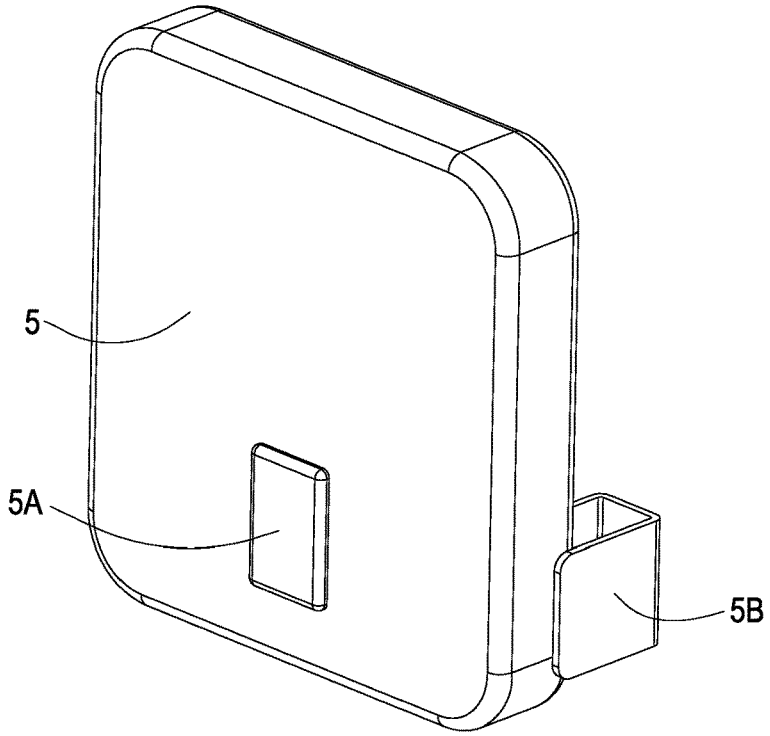
FIG. 5*a* is a front view of the structure of a varistor of this disclosure.
Figure 5B:
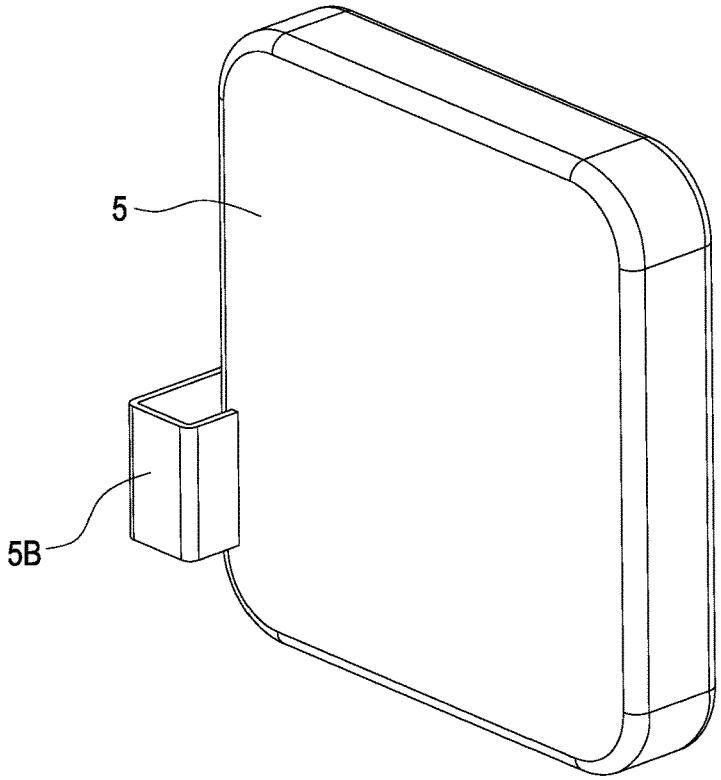
FIG. 5*b* is a back view of the structure of a varistor of this disclosure.
Figure 6:
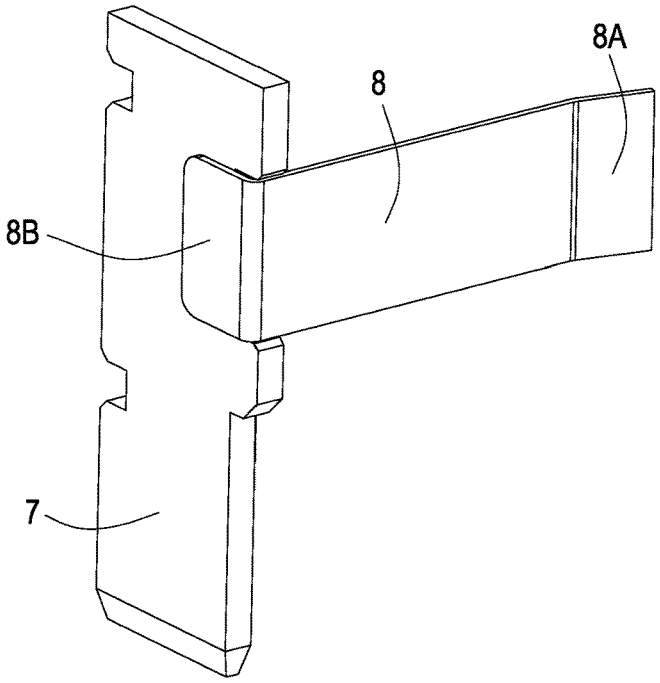
FIG. 6 is a schematic view of the structure of a bridge bracket of a release mechanism connected to a second electrical connection pin in accordance with this disclosure.
Figure 7:
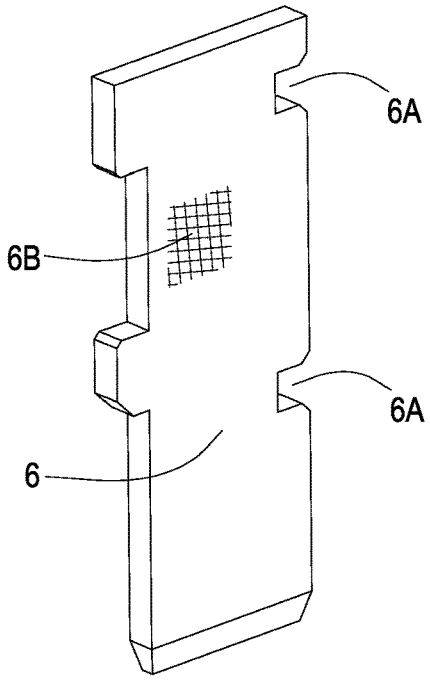
FIG. 7 is a schematic view of the structure of a release mechanism of a first electrical connection pin of this disclosure.

With reference to FIGS. 4*a* and 4*b*, the internal box body 2 comprises: a panel, a function rotating member placement slot 2A, a fixed column 2B, a second electrical connection pin fixing slot 2C, a remote linkage rod passing hole 2D, a first electrical connection pin fixing slot 2E, a spring fixing column 2F, a varistor placement slot 2G, a varistor's second electrode slot 2H, a varistor's first electrode passing hole 2K, a shear plane 2M and a failure status indicating area 2N, where the shear plane 2M has a slope 2M-2 formed with a smaller acute angle and a plane 2M-1; the varistor's first electrode passing hole 2K and the fixed column 2B are disposed on the panel 2A.

Figure 8A:
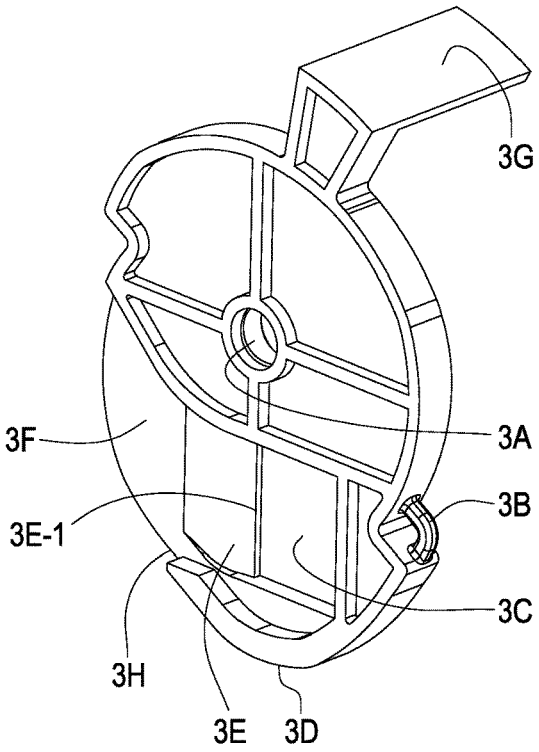
FIG. 8*a* is a front view of the structure of a function rotating member of a release mechanism of this disclosure.
Figure 8B:
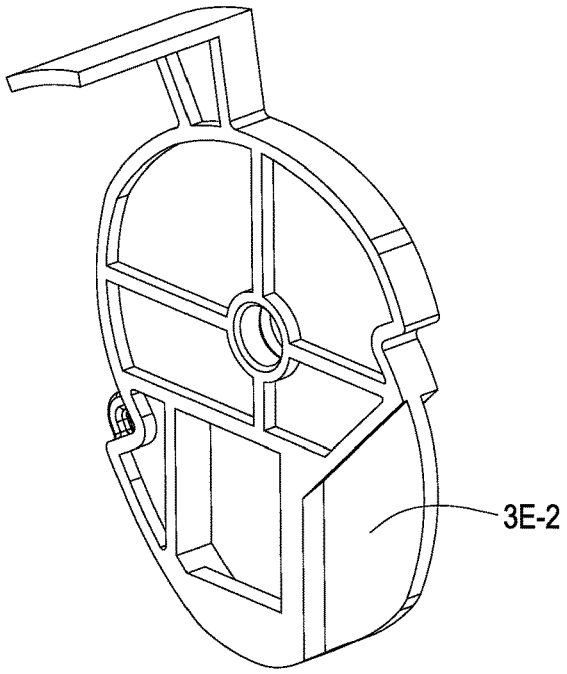
FIG. 8*b* is a back view of the structure of a function rotating member of a release mechanism of this disclosure.
Figure 9A:
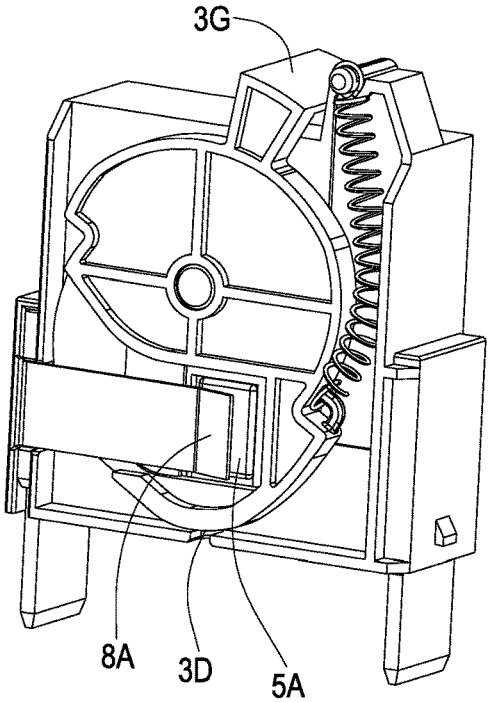
FIG. 9*a* is a schematic view showing a normal operation status of a release mechanism of this disclosure.
Figure 9B:
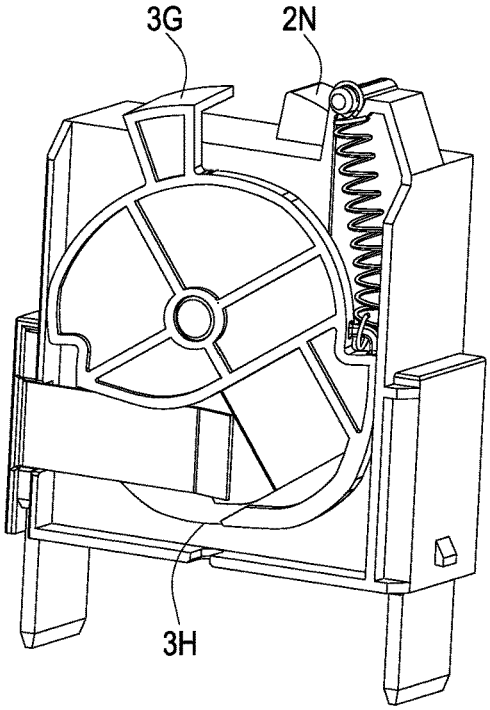
FIG. 9*b* is a schematic view showing a release status of a release mechanism of this disclosure.

With reference to FIGS. 8*a* and 8*b*, the function rotating member 3 has a function rotating member fixing hole 3A, a spring connecting ring 3B, a soldering window 3C, a remote linkage rod contact wall 3D, a shear slope 3E, an arc shield plate 3F, a normal status indicating area 3G and a remote linkage notching 3H, where the color of the normal status indicating area 3G is different from the color of the failure status indicating area 2N of the internal box body 2, and the shear slope 3E has a slope 3E-1 formed with a smaller acute angle and a plane 3E-2, and the shear slope 3E is disposed on a side of the soldering window 3C.

Figure 3A:
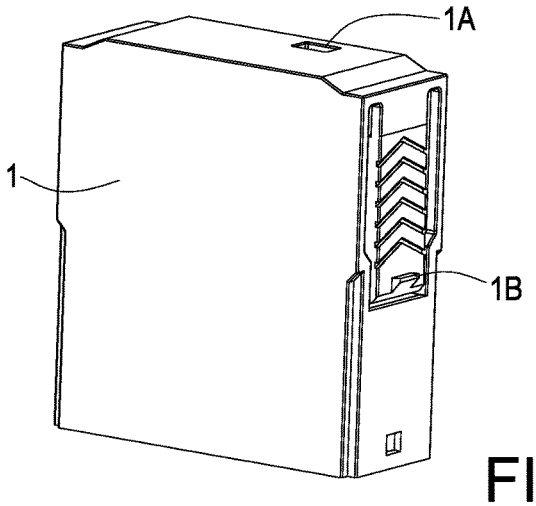
FIG. 3*a* is a schematic view of the structure of an external box body of a surge protector of this disclosure.

In FIG. 3*a*, the external box body 1 has a monitoring hole 1A and a lock 1B.

In FIGS. 3*a*-8*b*, the internal box body 2 is made of an insulating, temperature resisting and flame retardant material. The first electrical connection pin 6 is disposed in a first pin fixing slot 2E electrically coupled to the internal box body 2 and has two positioning recesses 6A latched with a protruded member in the first pin fixing slot 2E. The second electrical connection pin 7 is fixed and installed in the fixing slot 2C of the second electrical connection pin 7, and the varistor 5 is installed into the varistor placement slot 2G of the internal box body 2, and the varistor's second electrode 5B is installed in the varistor's second electrode slot 2H and soldered with the first electrical connection pin 6 in the soldering area 6B, and the soldering area 6B is processed with a special surface treatment.

The function rotating member 3 is made of an insulating, temperature resisting, and flame retardant material, installed in the function rotating member placement slot 2A, and sheathed on the fixed column 2B, and the function rotating member 3 is installed between the varistor 5 and the bridge bracket 8 and coupled to the elastic driving device 4, wherein the elastic driving device 4 is preferably a spring 4. The spring of the elastic driving device 4 has an end coupled to the spring connecting ring 3B and the other end coupled to the spring fixing column 2F of the internal box body. A fixing end 8B of the bridge bracket 8 is fixed and coupled to the second electrical connection pin 7 directly. The bridge bracket 8 is preferably pivotally coupled to the second electrical connection pin 7 in order to save the conductive wire coupled between them, so as to simplify the structure and reduce the quantity of components.

With reference to FIGS. 8*a*-9*b*, when the varistor 5 is situated at a normal status, the function rotating member 3 is situated at the first position, and the spring of the elastic driving device 4 is situated at the stretched status, and a soldering end 8A of the bridge bracket 8 is deformed by forces and then soldered with the soldering window 3C, the varistor's first electrode passing hole 2K and the varistor's first electrode 5A at low temperature, and the bridge bracket 8 is made of metal with an elasticity, so that the soldered bridge bracket 8 is capable of producing a restoring force according to the elastic deformation of the elastic body; and the normal status indicating area 3G of the function rotating member 3 is exposed from the monitoring hole 1A to indicate a normal status, and the remote linkage rod 9 of the surge protector is pressed down by the remote linkage rod contact wall 3D.

When the varistor 5 is situated at the release status, the elastic driving device 4 drives the function rotating member 3 to rotate around the fixed column 2B. In other words, the spring is contracted to its original status, and the function rotating member is rotated counterclockwise around the fixed column 2B under the effect of the spring of the elastic driving device 4, and the function rotating member 3 is rotated to the second position, so that the failure status indicating area 2N of the internal box body 2 is situated at the monitoring hole 1A and exposed from the monitoring hole 1A to indicate that the varistor 5 is situated at the release status, and the function rotating member 3 is rotated from the remote linkage rod contact wall 3D to the remote linkage notching 3H with respect to the point of action of the remote linkage rod 9, so as to release the remote linkage rod 9. The bridge bracket 8 will not rotate with the function rotating member 3, and the arc shield plate 3F provides a shielding effect between the bridge bracket 8 and the varistor's first electrode 5A, so that the wiring can be cut off more completely to prevent the conventional ceramic shielding body and release electrode plate from moving together. If distance between them is too short, the wiring cannot be cut off completely.

Preferably, the shear plane 2M is disposed on the varistor's first electrode passing hole 2K, and the shear slope 3E of the function rotating member 3 is matched with the shear plane 2M of the varistor's first electrode passing hole 2K and rotated with the rotation of the function rotating member 3 to produce a shear movement, so as to cut off the soldering wiring more completely and quickly. When the function rotating member 3 is rotated to the second position, the inner wall and the shear plane 2M of the varistor's first electrode passing hole 2K, the arc shield plate 3F of the function rotating member 3, and a surface of the varistor's first electrode 5A form a closed area, so that the electric arc can be eliminated more completely and quickly.

Figure 10A:
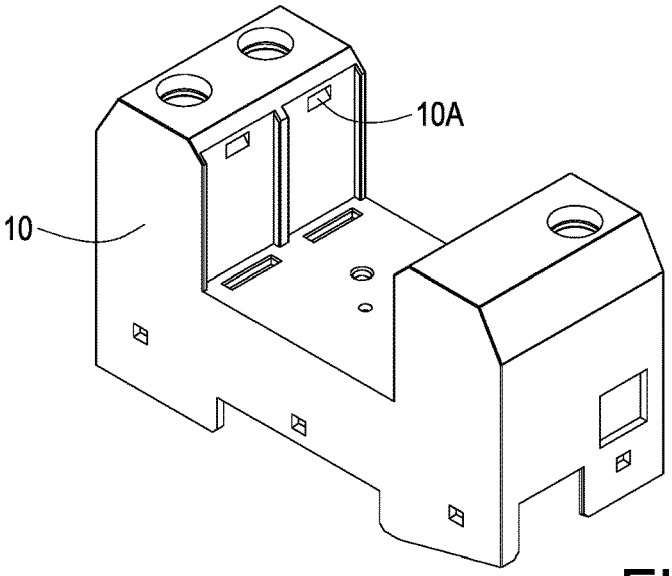
FIG. 10*a* is a schematic view of the structure of a cover of a surge protector of this disclosure.

With reference to FIGS. 10*a* and 3*a*, the base is a pluggable structure having a cover 10, an electrical connection member and a remote device, and a latch slot 10A is formed on an inner sidewall of the U-shaped plug slot of the cover 10. When the release mechanism is plugged, the latch slot 10A and the lock 1B of the external box body 1 are latched with each other, and the release mechanism and the base can be coupled conveniently and quickly, and such arrangement prevents the release mechanism from being loosened or falling out, so as to improve the product safety.

Figure 3B:
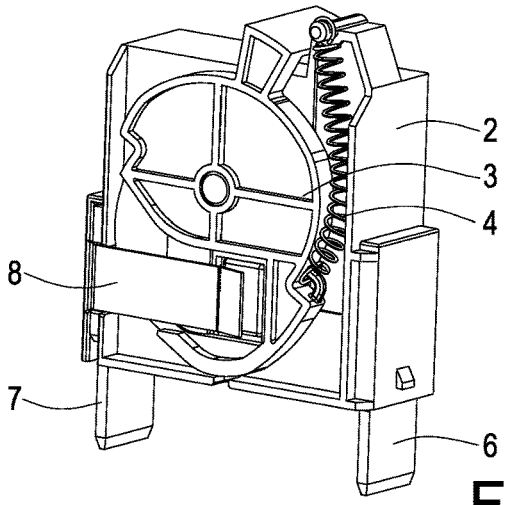
FIG. 3*b* is a schematic view of the structure of a release mechanism of this disclosure.
Figure 3C:
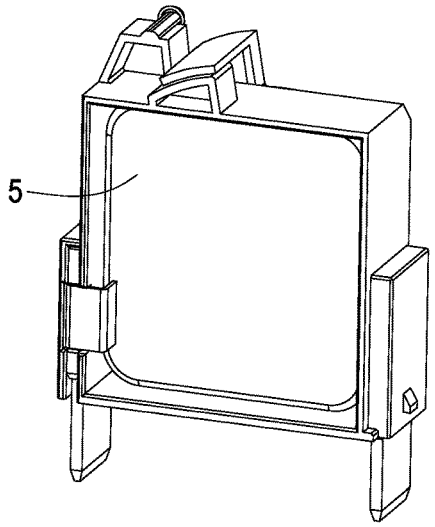
FIG. 3*c* is a schematic view of the structure of an internal box body a release mechanism of this disclosure.
Figure 10B:
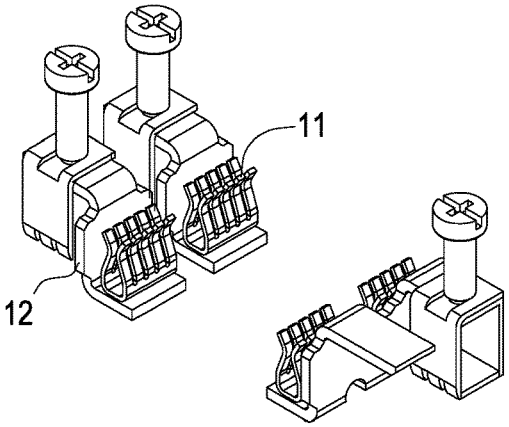
FIG. 10*b* is a schematic view of the structure of a metal claw of a base of a surge protector of this disclosure.

With reference to FIGS. 10*b* and 3*b*, the electrical connection member has a metal claw 11 and a conductive strip 12. The metal claw 11 and the conductive strip 12 are soldered by point soldering, and the metal claw 11 is clamped and coupled to the first electrical connection pin 6 and the second electrical connection pin 7 of the release mechanism to form a conducting channel.

Figure 10C:
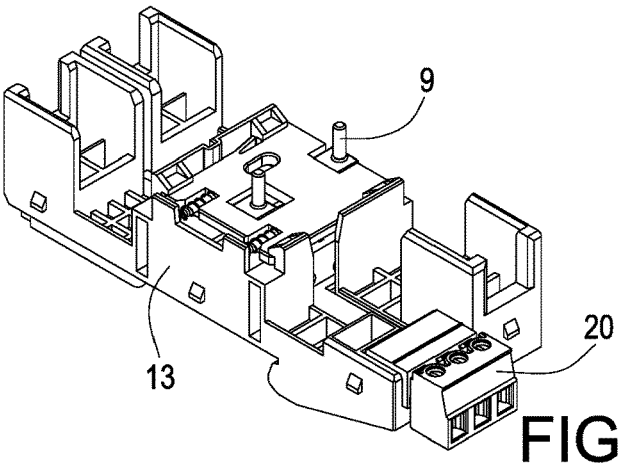
FIG. 10*c* is a schematic view of the structure of a seat of a base of a surge protector in accordance with this disclosure.
Figure 11:
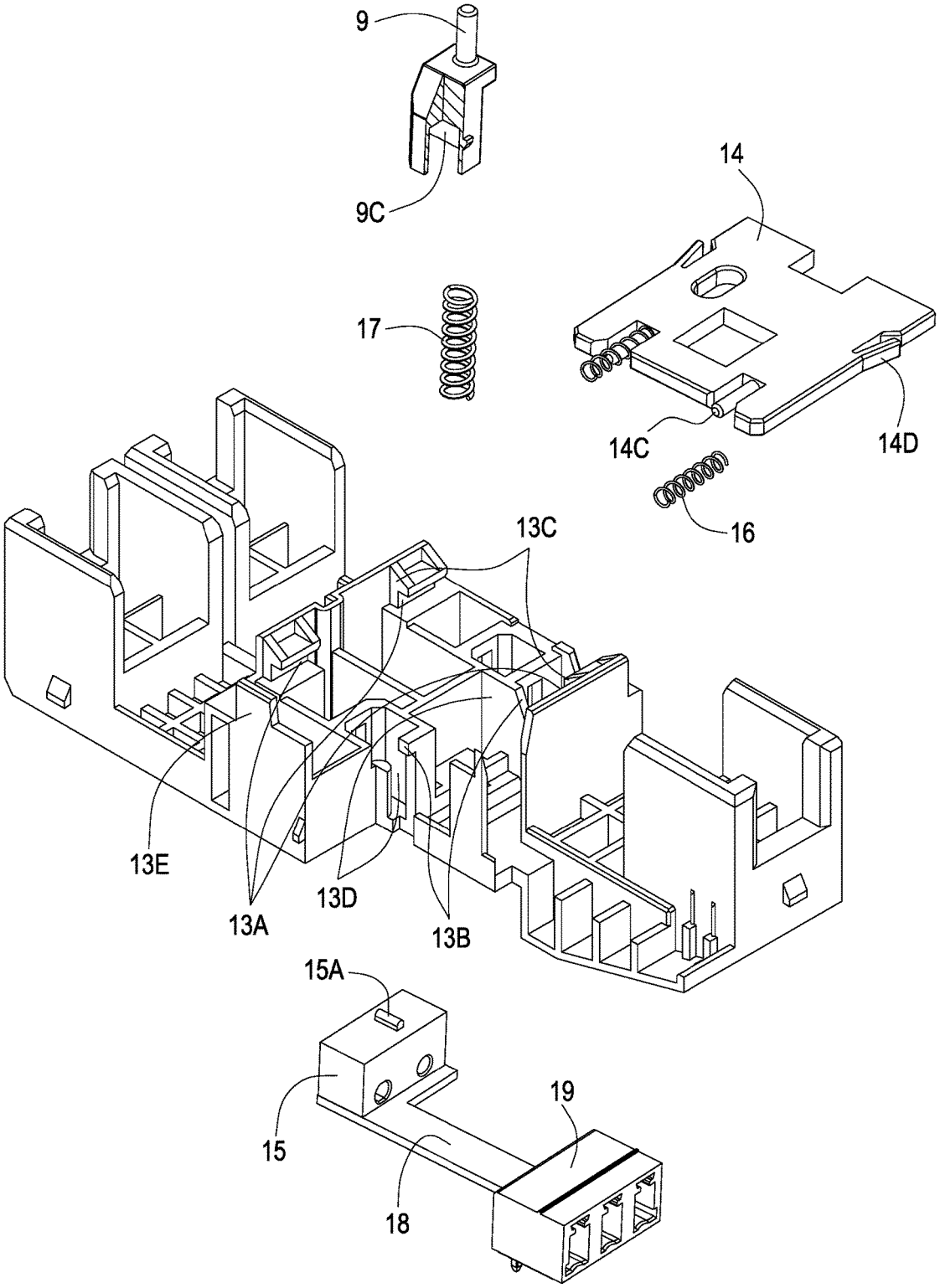
FIG. 11 is an exploded view of a remote device installed in a base in accordance with this disclosure.
Figure 12A:
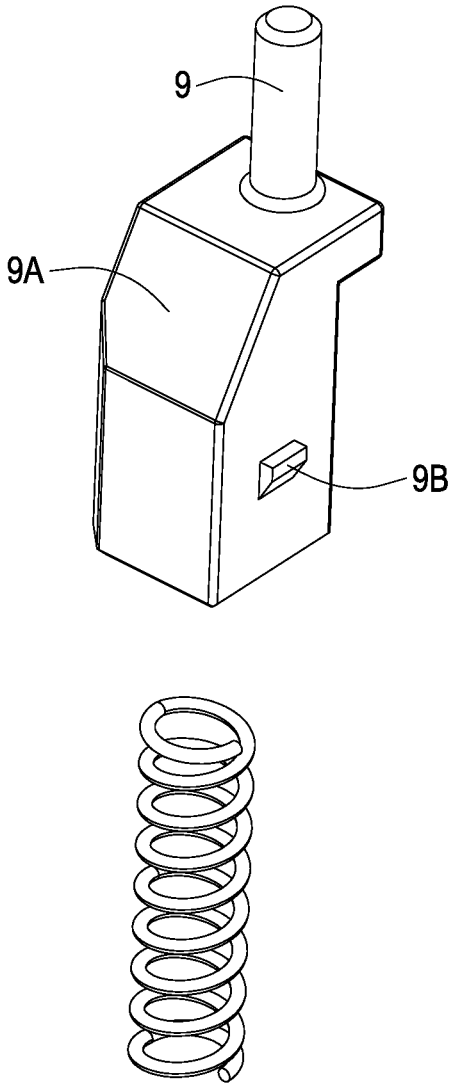
FIG. 12*a* is a front view of a remote linkage rod of a remote device of this disclosure.
Figure 12B:
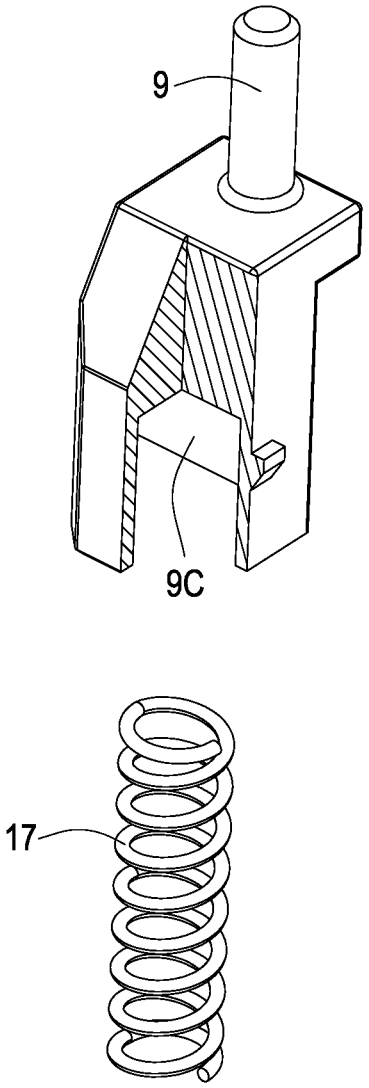
FIG. 12*b* is a back view of a remote linkage rod of a remote device of this disclosure.
Figure 13A:
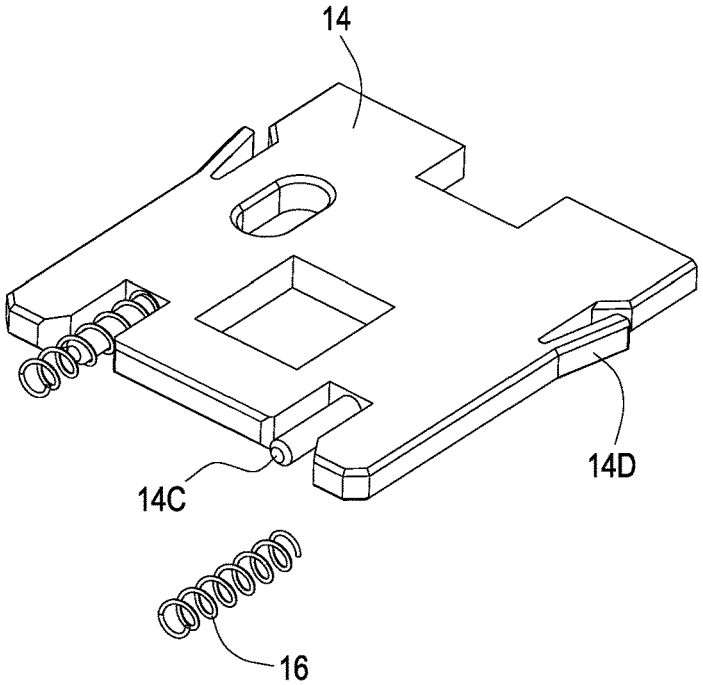
FIG. 13*a* is a front view of a combination of a slider and a slider spring of a base of a remote device in accordance with this disclosure.
Figure 13B:
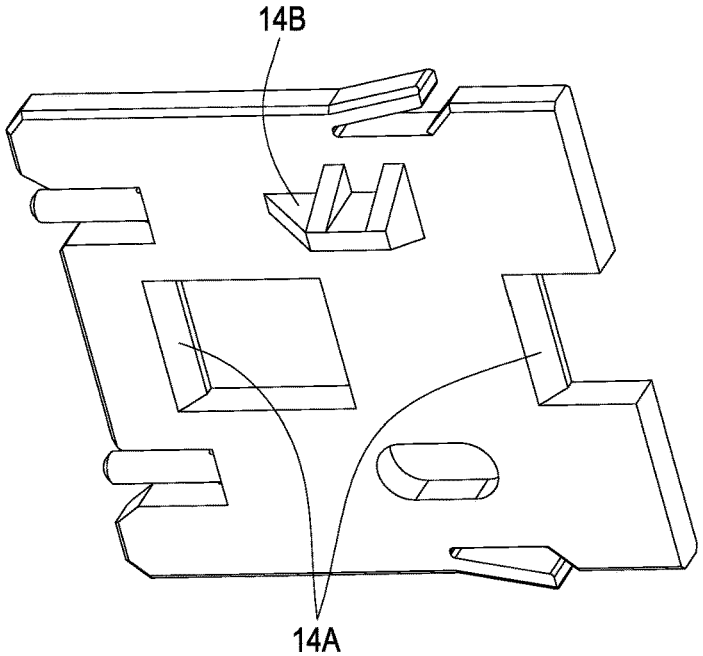
FIG. 13*b* is a back view of a slider of a seat of a remote device in accordance with this disclosure.

With reference to FIGS. 10*c* and 11, the remote device has a seat 13, a remote linkage rod 9, a remote linkage rod spring 17 and a remote connection terminal 20, and the remote connection terminal 20 may be coupled to a control system.

With reference to FIGS. 11-13*b*, the multi-stage surge protector is a two-stage surge protector, and the base of the surge protector of each stage is an independent linkage mechanical connection structure, and the remote device has as seat 13 with an end surface 13C, a sidewall 13E, a slider 14, a group of slide slots 13A, and the surge protector of each stage has a limit point 13B, a slider spring 16, a spring placement hole 13D, a bump 9B and a remote linkage rod internal hole 9C. The resultant force of two slider springs 16 is smaller than the elasticity of the single remote linkage rod spring 17. The slider 14 has a driven slope 14A, a micro switch driven block 14B, two spring fixing columns 14C and two positioning claws 14D, and the slider 14 is installed onto the slide slot 13A. The positioning claw 14 blocks the end surface 13C, and the two spring fixing columns 14C have a slider spring 16 each, and an end of the slider spring 16 abuts a sidewall 13E, so that the sidewall 13E provides a continuous pushing force to the slider 14. Both of the remote linkage rod 9 and the remote linkage rod spring 17 are installed into the spring placement holes 13D of the surge protector of each stage respectively, and the remote linkage rod spring 17 is installed into the remote linkage rod internal hole 9C. With the effect of the bump 9B and the limit point 13B, the installed remote linkage rod 9 will not be popped out by the link rod spring 17. The micro switch 15 and the terminal block 19 are soldered onto the circuit board 18, and the circuit board 18 with the micro switch 15 and the terminal block 16 are installed into the seat 13.

Figure 14:
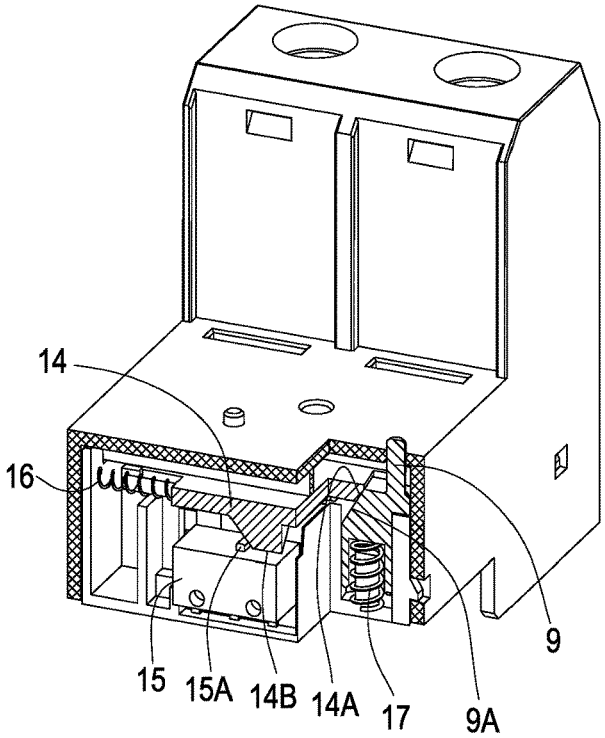
FIG. 14 is a schematic view showing the status of a remote device before the release mechanism is released in accordance with this disclosure.
Figure 16:
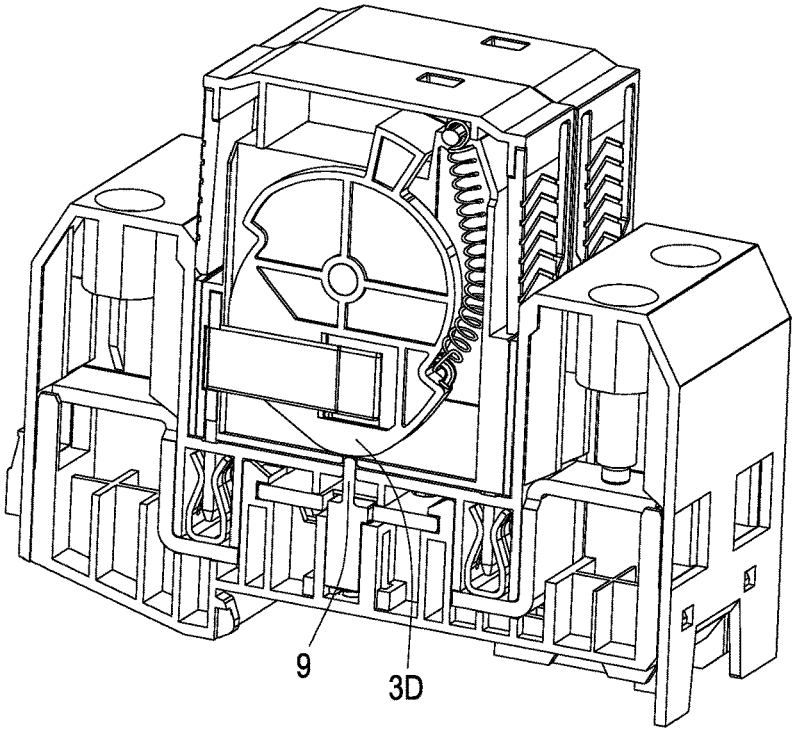
FIG. 16 is a schematic view showing the linkage of a base before the release mechanism is released in accordance with this disclosure.

With reference to FIGS. 14 and 16 for a varistor 5 situated at the normal operation status, the remote linkage rod 9 is pressed down by the remote linkage rod contact wall 3D of the function rotating member 3, and the remote linkage rod spring 17 is situated at a maximum compression status. Under the pushing effect of the slider spring 16, the driven slope 14A of the slider 14 is stopped at the right end of the slide slot 13A by the driving slope 9A of the remote linkage rod 9. Now, the micro switch driven block 14B on the slider has no action on the micro switch button 15A, and the micro switch button 15A is situated at a naturally pop-up status which indicates that the varistor is situated at a normal operation status.

Figure 15:
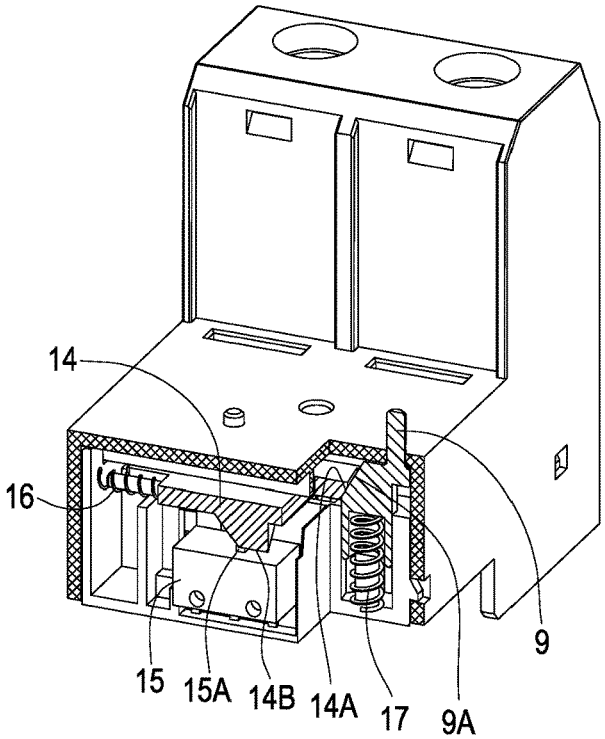
FIG. 15 is a schematic view showing the status of a remote device after the release mechanism is released in accordance with this disclosure.
Figure 17:
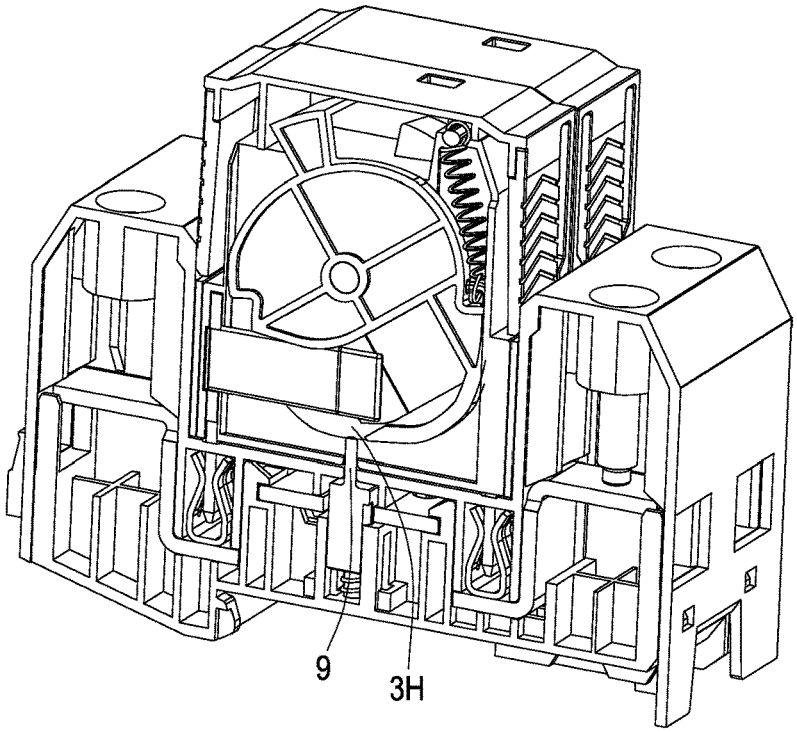
FIG. 17 is a schematic view showing the linkage of a base after the release mechanism is released in accordance with this disclosure.

With reference to FIGS. 15 and 17 for a varistor 5 situated at the release status, the function rotating member 3 is rotated counterclockwise to the second position, and the function rotating member 3 is rotated from the remote linkage rod contact wall 3D to the remote linkage notching 3H with respect to the point of action of the remote linkage rod 9. When the functional rotating member 3 is rotated to a position above the remote linkage rod 9, the remote linkage rod 9 has an upward movement space and pops upward under the pushing effect of the remote linkage rod spring 17 to indicate that the varistor 5 is situated at the release status (which is the failure status). Under the elastic effect of the driving slope 9A, the driven slope 14A drives the slider 14 to move leftward along the slide slot 13A. After the remote linkage rod 9 has been popped completely, the slider 14 is situated at a maximum displacement of the stroke, and the slider spring 16 is compressed, and the micro switch driven block 14B presses down the micro switch button 15A. Since the resultant force of two slider springs 16 is smaller than the elasticity of a single remote linkage rod spring 17, just a micro switch and a slider can release the surge protector of any level, and then the remote device will issue a failure warning signal to the control system to assure an effective feedback to the control end for each time of release and remind maintenance people to replace the surge protector timely, so as to achieve the effects of improving the safety and reliability of the surge protector, reducing the quantity of components, facilitating the manufacturing process, and lowering the cost.

In summation of the description above, the release mechanism of this disclosure is capable of cutting off the electric arc and the soldering wiring between the varistor pin and the bridge bracket completely and quickly, while providing a status indication and a remote function.

The base of this disclosure simply adopts a micro switch and a slider component, such that when a surge protector of any level is released, the remote device will issue a signal to improve the safety and reliability of the surge protector.

What is claimed is:

1. A release mechanism of a surge protector, the release mechanism comprising an internal box body (2), a function rotating member (3), an elastic driving device (4), a first electrical connection pin (6), a second electrical connection pin (7) and a bridge bracket (8) accommodated in a varistor (5), and the first electrical connection pin (6) and the second electrical connection pin (7) being plugged into the internal box body (2), and a varistor's second electrode (5B) and the first electrical connection pin (6) being soldered, and the internal box body (2) having a fixed column (2B), and the function rotating member (3) having an arc shield plate (3F) and a soldering window (3C), and the function rotating member (3) being sheathed on the fixed column (2B) and disposed between the varistor (5) and the bridge bracket (8), and the elastic driving device (4) having an end coupled to the function rotating member (3) and another end fixed to the internal box body (2), wherein an end of the bridge bracket (8) is directly fixed and coupled to the second electrical connection pin (7), such that when the varistor (5) is situated at a normal status, the function rotating member (3) is situated at a first position, and another end of the bridge bracket (8) is passed through the soldering window (3C) and soldered with a varistor's first electrode (5A) at low temperature, and when the varistor (5) is situated at a release status, the elastic driving device (4) drives the function rotating member (3) to rotate around the fixed column (2B), so that when the function rotating member (3) is rotated to a second position, the arc shield plate (3F) provides a shielding effect between the bridge bracket (8) and the varistor's first electrode (5A).

2. The release mechanism of claim 1, wherein the soldering window (3C) has a shear slope (3E) disposed on a side of the soldering window (3C), and the internal box body (2) has a panel (2A), and the panel (2A) has a varistor's first electrode passing hole (2K) aligned precisely with the soldering window (3C), and the varistor's first electrode passing hole (2K) has a shear plane (2M), so that when the function rotating member (3) is rotated, the shear slope (2M) and the shear plane (3E) of the soldering window (3C) are moved with respect to each other.

3. The release mechanism of claim 2, wherein when the function rotating member (3) is rotated to the second position, an inner wall and the shear plane (2M) of the varistor's first electrode passing hole (2K), the arc shield plate (3F) of the function rotating member (3), and a surface of the varistor's first electrode (5A) form a closed area.

4. The release mechanism of claim 1, wherein the release mechanism has an external box body (1), and the external box body (1) has a monitoring hole (1A), and the internal box body (2) has a failure status indicating area (2N), and the function rotating member (3) has a normal status indicating area (3G), and the color of the normal status indicating area (3G) and the color of the failure status indicating area (2N) are different, and the function rotating member (3) is situated at the first position, and the normal status indicating area (3G) is exposed from the monitoring hole (1A), and the function rotating member (3) is rotated to the second position, so that the failure status indicating area (2N) is disposed at and exposed from the monitoring hole (1A).

5. The release mechanism of claim 1, wherein the elastic driving device (4) is a spring, and when the varistor (5) is situated at the normal status, the function rotating member (3) is situated at the first position, and the spring is situated at a stretched status, and when the varistor (5) is situated at the release status, the spring is contracted, and the function rotating member (3) is rotated from the first position to the second position around the fixed column (2B) under the effect of the spring.

6. The release mechanism of claim 5, wherein both of the function rotating member (3) and the internal box body (2) are made of a temperature resisting, insulating, and flame retardant material.

7. A surge protector, comprising: at least one varistor (5); a base; and at least one release mechanism, including an internal box body (2), a function rotating member (3), an elastic driving device (4), a first electrical connection pin (6), a second electrical connection pin (7) and a bridge bracket (8), accommodated in the varistor (5), and the first electrical connection pin (6) and the second electrical connection pin (7) being plugged in the internal box body (2), and a varistor's second electrode (5B) and the first electrical connection pin (6) being soldered, and the internal box body (2) having a fixed column (2B), and the function rotating member (3) having an arc shield plate (3F) and a soldering window (3C), and the function rotating member (3) being sheathed on the fixed column (2B) and disposed between the varistor (5) and the bridge bracket (8), and the elastic driving device (4) having an end coupled to the function rotating member (3) and another end fixed to the internal box body (2), wherein an end of the bridge bracket (8) is directly fixed and coupled to the second electrical connection pin (7), and when the varistor (5) is situated at a normal status, the function rotating member (3) is situated at a first position, and another end of the bridge bracket (8) is passed through the soldering window (3C) and soldered with a varistor's first electrode (5A) at low temperature, and when the varistor (5) is situated at a release status, the elastic driving device (4) drives the function rotating member (3) to rotate around the fixed column (2B), such that when the function rotating member (3) is rotated to a second position, the arc shield plate (3F) provides a shielding effect between the bridge bracket (8) and the varistor's first electrode (5A).

8. The surge protector of claim 7, wherein the soldering window (3C) has a shear slope (3E) disposed on a side of the soldering window (3C), and the internal box body (2) has a panel (2A), and the panel (2A) has a varistor's first electrode passing hole (2K) aligned precisely with the soldering window (3C), and the varistor's first electrode passing hole (2K) has a shear plane (2M), so that when the function rotating member (3) is rotated, the shear slope (2M) and the shear plane (3E) of the soldering window (3C) are moved with respect to each other.

9. The surge protector of claim 8, wherein when the function rotating member (3) is rotated to the second position, an inner wall and the shear plane (2M) of the varistor's first electrode passing hole (2K), the arc shield plate (3F) of the function rotating member (3), and a surface of the varistor's first electrode (5A) form a closed area.

10. The surge protector of claim 7, wherein the release mechanism has an external box body (1), and the external box body (1) has a monitoring hole (1A), and the internal box body (2) has a failure status indicating area (2N), and the function rotating member (3) has a normal status indicating area (3G), and the color of the normal status indicating area (3G) and the color of the failure status indicating area (2N) are different, and the function rotating member (3) is situated at the first position, and the normal status indicating area (3G) is exposed from the monitoring hole (1A), and the function rotating member (3) is rotated to the second position, so that the failure status indicating area (2N) is disposed at and exposed from the monitoring hole (1A).

11. The surge protector of claim 10, wherein the elastic driving device (4) is a spring, and when the varistor (5) is situated at the normal status, the function rotating member (3) is situated at the first position, and the spring is situated at a stretched status, and when the varistor (5) is situated at the release status, the spring is contracted, and the function rotating member (3) is rotated from the first position to the second position around the fixed column (2B) under the effect of the spring.

12. The surge protector of claim 11, wherein both of the function rotating member (3) and the internal box body (2) are made of a temperature resisting, insulating, and flame retardant material.

* * * * *